US012635791B2

(12) United States Patent
Chen et al.

(10) Patent No.: US 12,635,791 B2
(45) Date of Patent: May 26, 2026

(54) ORIGAMI-BASED FOLDABLE FURNITURE ASSEMBLY

(71) Applicant: A&C Future Inc, Newport Beach, CA (US)

(72) Inventors: Shoue Chen, Irvine, CA (US); Jiuqi Wang, Santa Ana, CA (US); Qiyin Pan, Irvine, CA (US); Han Qin, Newport Beach, CA (US); Jiayang Qin, Newport Beach, CA (US)

(73) Assignee: A&C FUTURE INC.

( * ) Notice: Subject to any disclaimer, the term of this patent is extended or adjusted under 35 U.S.C. 154(b) by 173 days.

(21) Appl. No.: 18/513,512

(22) Filed: Nov. 18, 2023

(65) Prior Publication Data

US 2025/0160508 A1 May 22, 2025

(51) Int. Cl.
*A47B 3/14* (2006.01)
*A47C 4/20* (2006.01)

(52) U.S. Cl.
CPC ..... *A47B 3/14* (2013.01); *A47C 4/20* (2013.01); *A47B 2003/145* (2013.01)

(58) Field of Classification Search
CPC ..... B60N 2/36; B60N 2/065; A47B 83/02; A47B 3/14; A47B 2003/145
USPC ..... 297/119, 135, 139, 159.1; 108/33
See application file for complete search history.

(56) References Cited

U.S. PATENT DOCUMENTS 1,332,635 A * 3/1920 Puff ..... A47B 3/14 5/315.2
1,736,531 A * 11/1929 Hodinka ..... A47B 3/14 297/55
2,436,730 A * 2/1948 Repke ..... A47B 3/14 108/35
2,613,728 A * 10/1952 Loibl, Sr. ..... A47B 3/14 297/440.22
2,647,562 A * 8/1953 Hoffar ..... A47B 3/14 108/35
3,885,829 A * 5/1975 Haeger ..... A47B 3/14 108/38
4,223,945 A * 9/1980 Nikitits ..... A47B 3/14 108/166
4,229,038 A * 10/1980 Drost ..... A47C 4/14 108/174
4,883,314 A * 11/1989 Sakong ..... A47B 3/14 248/188.5
4,960,303 A * 10/1990 York ..... A47B 3/14 297/139

(Continued)

*Primary Examiner* — Jose V Chen
(74) *Attorney, Agent, or Firm* — Elizabeth Yang

(57) ABSTRACT

A foldable origami-shaped furniture assembly includes floor panels including a first floor panel and a second floor panel. The first and second floor panels are pivotally moveable between a folded position and a deployed position. A table includes a first member and a second member. The first and second members are pivotally moveable between a folded position and a deployed position. A plurality of chairs, each chair is adapted to be in a folded state and in an expanded state. A cable that passes through the table and the chairs such that the cable is passively pulled when the first and second floor panels become coplanar and the first and second members become coplanar. Each chair is expanded with a front leg of the leg sliding along a channel for expanding the chair. A plurality of legs support the table in the deployed position.

4 Claims, 16 Drawing Sheets

(56) References Cited

U.S. PATENT DOCUMENTS

| | | | | | |
|---|---|---|---|---|---|
| 5,029,938 | A * | 7/1991 | Song | A47B 83/02 | 108/35 |
| 6,065,802 | A * | 5/2000 | Bue | A47B 3/14 | 297/170 |
| 6,666,151 | B2 * | 12/2003 | Adams | A47B 3/02 | 108/118 |
| 7,922,245 | B1 * | 4/2011 | Sawhney | A47C 11/00 | 297/159.1 |
| 10,174,515 | B1 * | 1/2019 | Krivens | A47B 83/02 | |
| 10,450,744 | B2 * | 10/2019 | Hall | E04B 5/43 | |
| 11,871,857 | B2 * | 1/2024 | Burger | A47B 83/02 | |
| 11,918,106 | B2 * | 3/2024 | Choi | A47B 83/02 | |
| 2005/0242633 | A1 * | 11/2005 | Frobose | A47B 3/14 | 297/157.1 |
| 2012/0175918 | A1 * | 7/2012 | Southwick | B29C 49/00 | 297/135 |
| 2015/0084383 | A1 * | 3/2015 | Zhu | A47B 3/02 | 297/139 |
| 2015/0375640 | A1 * | 12/2015 | Yin | B60N 3/063 | 297/157.1 |
| 2021/0112968 | A1 * | 4/2021 | Ponomar | A47C 11/00 | |
| 2023/0059531 | A1 * | 2/2023 | Saarinen | A63F 7/0692 | |

* cited by examiner

ORIGAMI-BASED FOLDABLE FURNITURE ASSEMBLY

BACKGROUND OF THE INVENTION

Field of the Invention

The present invention relates generally to furniture systems and more particularly to a foldable table and chairs set which is adapted to transition between a deployed position and folded position.

Description of the Related Art

Conventional table and chair sets are often bulky and non-foldable, which makes them difficult to store and transport. Additionally, they may not be well-suited for use in recreational vehicles (RVs), which have limited space. RVs are typically much smaller than traditional homes and conventional furniture cannot be folded up and stored away when not in use. This occupies space preventing users from doing other activities, such as cooking, sleeping, and relaxing. Also, RVs have a weight limit which limits use of conventional furniture.

Some of the tables and chairs can be folded and effectively stored. However, such foldable tables and chairs are not passively folded and unfolded and further, may require a user to independently unfold and fold table and chairs. The table and the chairs may not always remain connected on the floor.

People desire an origami-inspired table and chair set designed to be foldable and lightweight, making it easy to store and transport the furniture for users. Additionally, the people desire origami-inspired furniture which can be used in a variety of different settings, both indoors and outdoors. People desire origami-inspired furniture that can be integrated directly onto a foldable floor system.

None of the existing furniture items provide a convenient, effective, and efficient way to fold tables and chairs to save space and to provide convenience in RVs.

A need also exists for foldable furniture that can be folded up for easy storage and transport, which is important for RVs and other small spaces.

While conventional foldable furniture may be available, they would not be as suitable for the purposes of the present invention as disclosed hereafter. None of such conventional furniture, tables and chairs disclose the unique structures and advantages of the present disclosure. The devices disclosed herein avoid many of the drawbacks of existing devices.

Accordingly, there is a need for improved and foldable table and chairs set that can be folded, deployed and used inside RVs.

It is one prospect of the present invention to provide a novel table and chairs assembly of simple but effective construction for convenient and efficient use and storage in RVs.

Another object of the present invention is to provide a furniture assembly that can be folded easily allowing a user to carry and store the furniture assembly easily.

Yet another object of the disclosed invention is to provide a furniture assembly that includes a table, floor panels and a plurality of chairs interconnected through a cable system for folding and expansion.

As disclosed in this application, the inventor has discovered novel and unique origami-based furniture for efficiently and effectively folding and deploying table and chairs inside RVs.

Embodiments of the present invention provide for a foldable furniture assembly as described and defined in the description below and in the annexed claims which provide for improved safety, efficiency, and effectiveness characteristics in order to conveniently and more effectively use furniture inside RVs.

SUMMARY OF THE INVENTION

The following presents a simplified summary of the present disclosure in a simplified form as a prelude to the more detailed description that is presented herein.

Therefore, in accordance with embodiments of the invention, there is provided a foldable table and chair set. The foldable table and chair set is designed to be in a deployed position for using the chair set and table. The foldable table and chair set comprises a first floor panel foldably connected to a second floor panel. A table has pivotally connected members. A plurality of chairs is included in the set, each chair is adapted to transition between a folded position and an expanded position. In the folded position, the chair is accommodated in a channel disposed in the floor panel and in the expanded position, the chair vertically extends from the floor panel.

Preferably, the table and chair set includes a cable extending through the table and the sets of the chairs, wherein the cable is passively pulled to expand the table and the sets of the chairs.

In a preferred embodiment, the foldable table and chair assembly includes a first floor panel and a second floor panel. Both the panels are in a coplanar alignment in the deployed position of the assembly. A table is deployed between a first pair of chairs and a second pair of chairs. The first pair and the second pair are positioned on opposite sides of the table. The table includes a first rigid pivotal rectangular member and a second rigid pivotal rectangular member which are pivotally connected to each other. The table is supported by a first pair of legs and a second pair of legs, with foldable panels associated with each leg for providing additional support to the table. A sliding channel is integrated to each rigid pivotal rectangular member, allowing the legs to slide for folding and unfolding the table. A cable extends through the table and the pairs of the chairs for enabling passive expansion of the assembly by passive pulling of the cable when the floor panels move away from each other. When the cable is passively pulled, the first rigid pivotal rectangular member and the second rigid pivotal rectangular member become coplanar and parallel to the floor panels.

In a preferred embodiment, the first floor panel and the second floor panel are each rectangular or square in shape.

In a preferred embodiment, the first rigid pivotal rectangular member and the second rigid pivotal rectangular member are each rectangular in shape.

In a preferred embodiment, the first floor panel and the second floor panel each includes a channel for sliding a front leg of a chair to expand the chair.

In one embodiment, the table and each chair are made of wood, plastic, or metal.

In another embodiment, the cable is manually pulled by a user to expand the floor panels and the table.

These and other features, aspects, and advantages of the present invention will become better understood with reference to the following description and appended claims.

BRIEF DESCRIPTION OF THE DRAWINGS

Illustrative embodiments of the present invention are described herein with reference to the accompanying drawings, in which.

DETAILED DESCRIPTION

Figure 1:
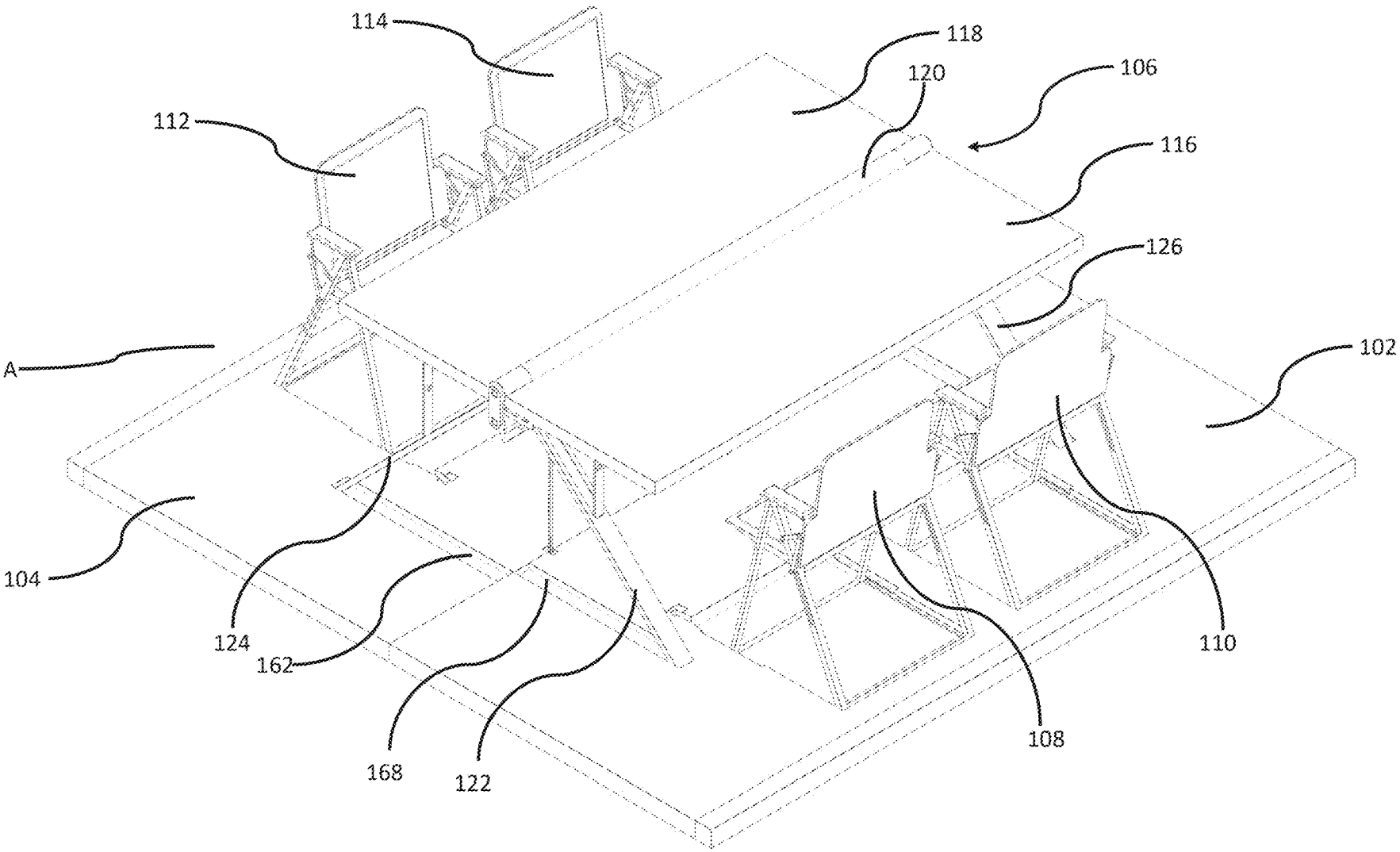
FIG. 1 illustrates the foldable table and chair set assembly of the present invention in a deployed position, in accordance with embodiments of the invention.

For a further understanding of the nature and function of the embodiments, reference should be made to the following detailed description. Detailed descriptions of the embodiments are provided herein, as well as, the best mode of carrying out and employing the present invention. It will be readily appreciated that the embodiments are well adapted to carry out and obtain the ends and features mentioned as well as those inherent herein. It is to be understood, however, that the present invention may be embodied in various forms. Therefore, persons of ordinary skill in the art will realize that the following disclosure is illustrative only and not in any way limiting, as the specific details disclosed herein provide a basis for the claims and a representative basis for teaching to employ the present invention in virtually any appropriately detailed system, structure or manner. It should be understood that the devices, materials, methods, procedures, and techniques described herein are presently representative of various embodiments. Other embodiments of the disclosure will readily suggest themselves to such skilled persons having the benefit of this disclosure.

Reference will now be made in detail to the present preferred embodiments of the invention, examples of which are illustrated in the accompanying drawings. Wherever possible, the same reference numerals are used in the drawings and the description to refer to the same or like parts.

Referring initially to FIGS. 1-9*b*, the basic constructional details and principles of operation of embodiments of a foldable table and chair assembly 100 are provided.

As illustrated in FIG. 1, in a preferred embodiment, the foldable table and chair assembly 100 includes a first floor panel 102 and a second floor panel 104. Both the first floor panel 102 and the second floor panel 104 are generally rectangular or rectangular. The first floor panel 102 and the second floor panel 104 are in a deployed position (Arrow A, FIG. 1) for unfolding the table and chairs set. The first floor panel 102 and the second floor panel 104 are symmetrical and substantially similar in size. In the deployed position, the first floor panel 102 and the second floor panel 104 are in coplanar alignment and can be placed on a floor.

In the deployed position of the assembly 100, a table 106 is deployed in an extended position between a first pair of chairs 108,110 and a second pair of chairs 112,114. The first pair of chairs 108,110 and the second pair of chairs 112,114 are positioned on opposite sides of the table 106.

Figure 2:
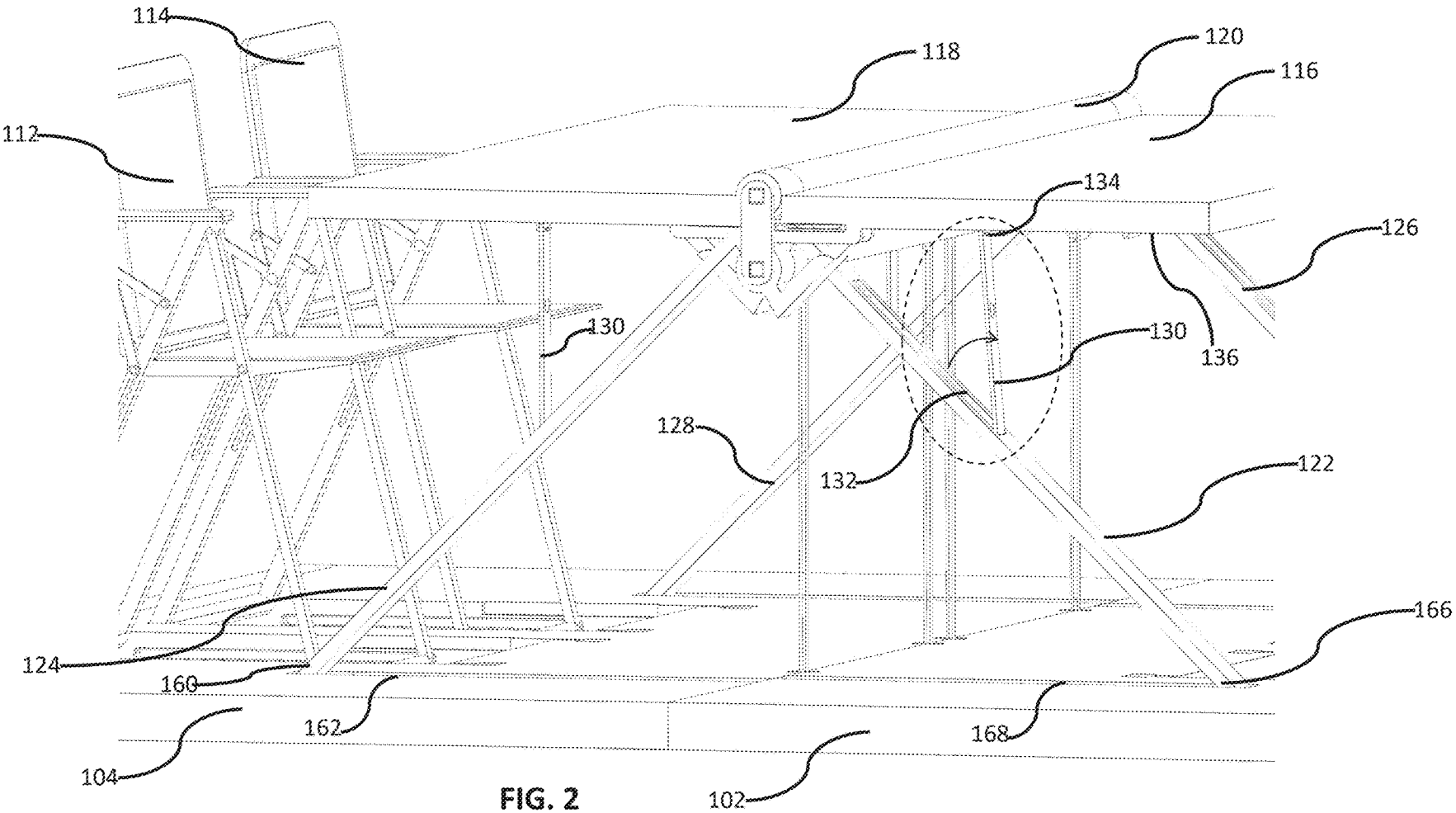
FIG. 2 illustrates a partial side perspective view of the foldable table and chair set assembly of the present invention in the deployed position, in accordance with embodiments of the invention.
Figure 3:
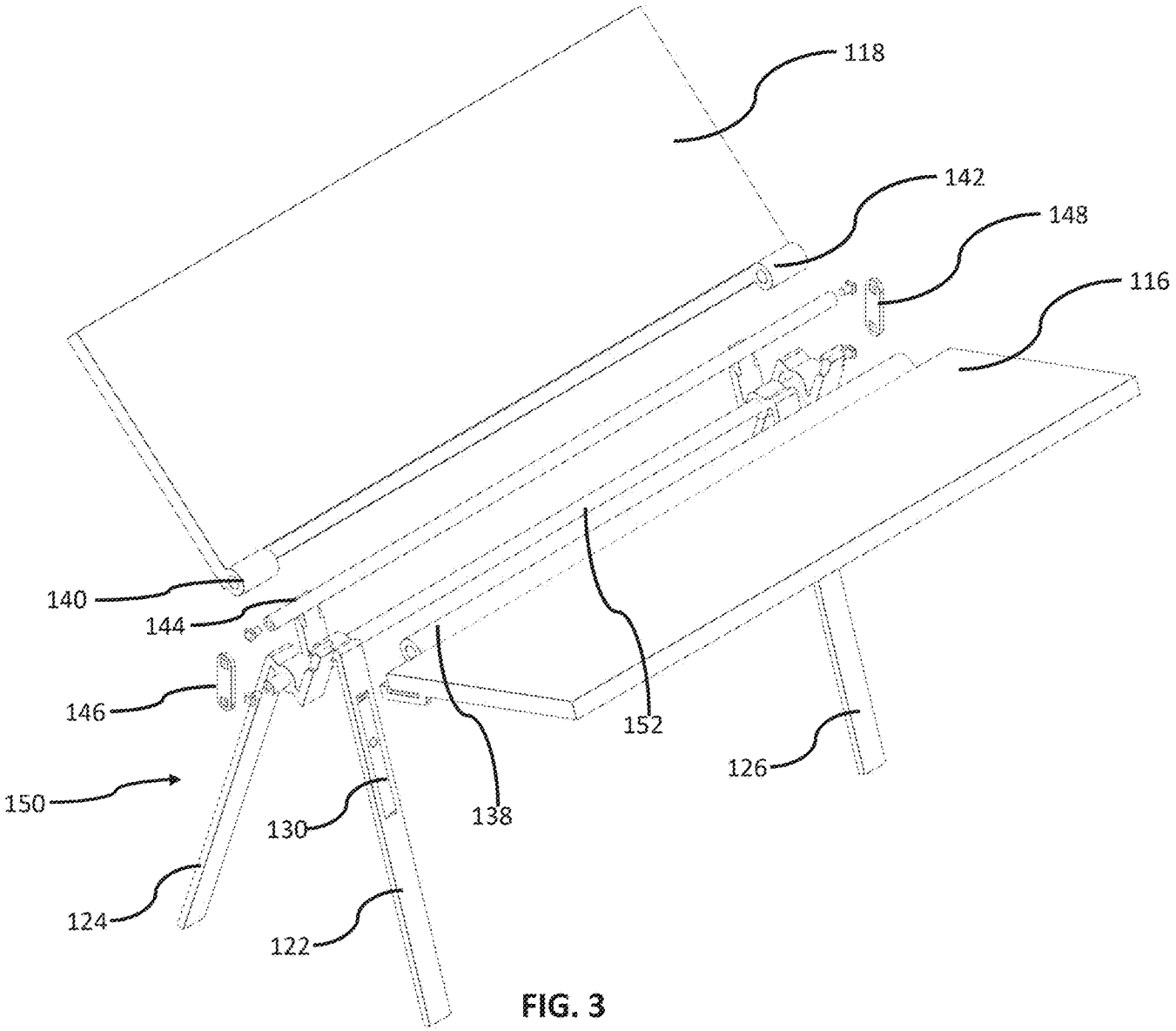
FIG. 3 illustrates an exploded view of the table used in the foldable table and chair set assembly of the present invention in accordance with embodiments of the invention.

Referring to FIGS. 1, 2 and 3, the table 106 includes a first rigid pivotal rectangular member 116 and a second rigid pivotal rectangular member 118. The pivotal members 116, 118 are pivotally connected along a common edge 120. The table 106 is supported by a first pair of legs 122,124 and a second pair of legs 126,128. For providing additional support to the rigid members 116,118 of the table 106 in the deployed position, a foldable panel 130 is associated with each leg of the table 106. The foldable panel 130 is adapted to transition from an uninstalled position wherein the foldable panel 130 is accommodated in a groove 132 positioned on the leg (exemplary shown in the leg 122) to an installed position wherein the foldable panel 130 is secured to a pin 134 positioned on the rear surface 136 of the table 106.

Referring now to FIG. 3, the rigid table member 116 includes a channel 138 which is aligned and positioned between the opposite accommodating members 140,142 disposed along the rigid table member 118. The piston rod 144 passes through the channel 138 and the members 140,142 and is secured to the fastening members 146,148 at the opposite ends. The fastening members 146,148 also secure to the legs frame 150 which includes the pair of legs 122,124 and other pair of legs 126,128 along with a legs connecting horizontal member 152. Different mechanical fasteners such as bolts can be used for securing the piston rod 144 and the legs frame 150.

Figure 4:
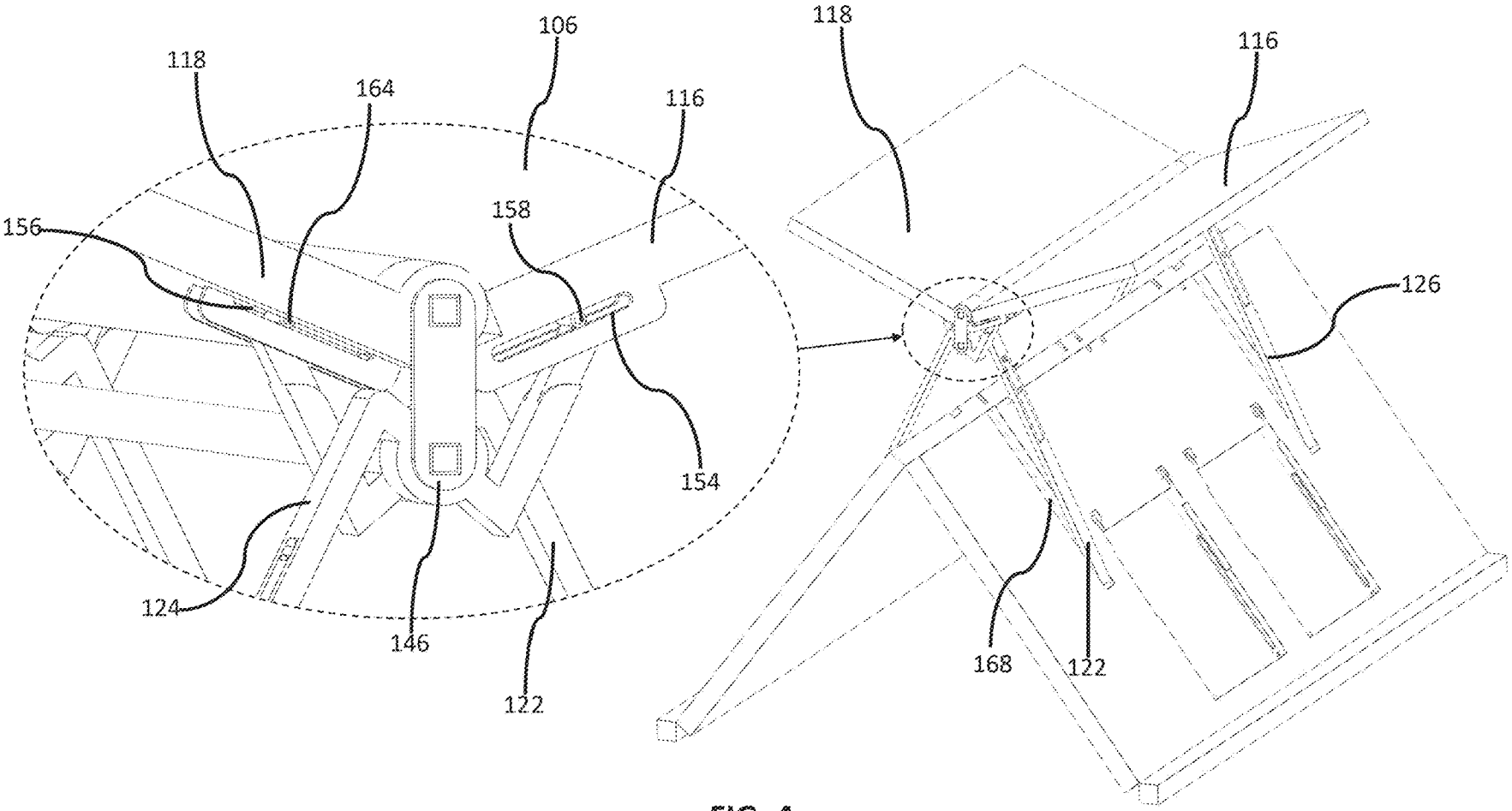
FIG. 4 illustrates a close view of the fastening and sliding mechanism of the table members, in accordance with embodiments of the invention.

Referring now to FIGS. 1, 2 and 4, a close view of the fastening member for maintaining folding and unfolding of the table 106 in accordance with one embodiment of the present invention. The rigid table member 116 includes an integrated sliding channel 154 and the rigid table member 118 includes a corresponding sliding channel 156. The top end 158 of the leg 124 slides along the channel 154 such that the bottom end 160 of the leg 124 is hinged at the end edge 182 of the channel 162 disposed on the floor panel 104. Similarly, the top end 164 of the leg 122 slides along the channel 156 such that the bottom end 166 of the leg 122 slides along the channel 168 disposed on the floor panel 102. It will be apparent to a person skilled in the art that similar sliding mechanism is deployed for the other pair of legs.

Figure 5A:
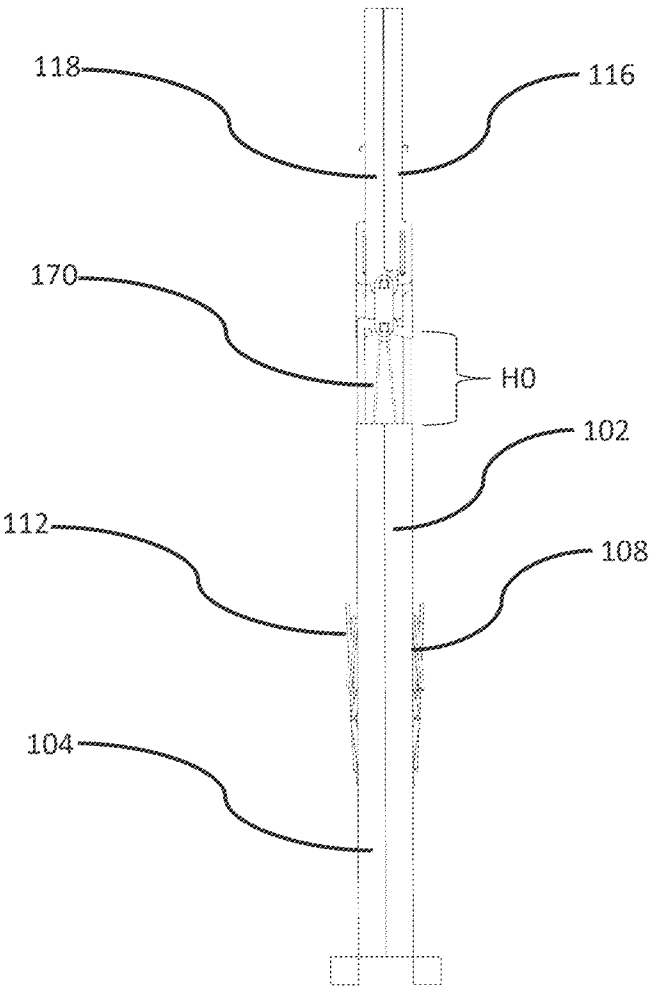
FIGS. 5*a*-5*d* illustrate different steps used for deploying the foldable table and chair set assembly of the present invention, in accordance with embodiments of the invention.
Figure 5B:
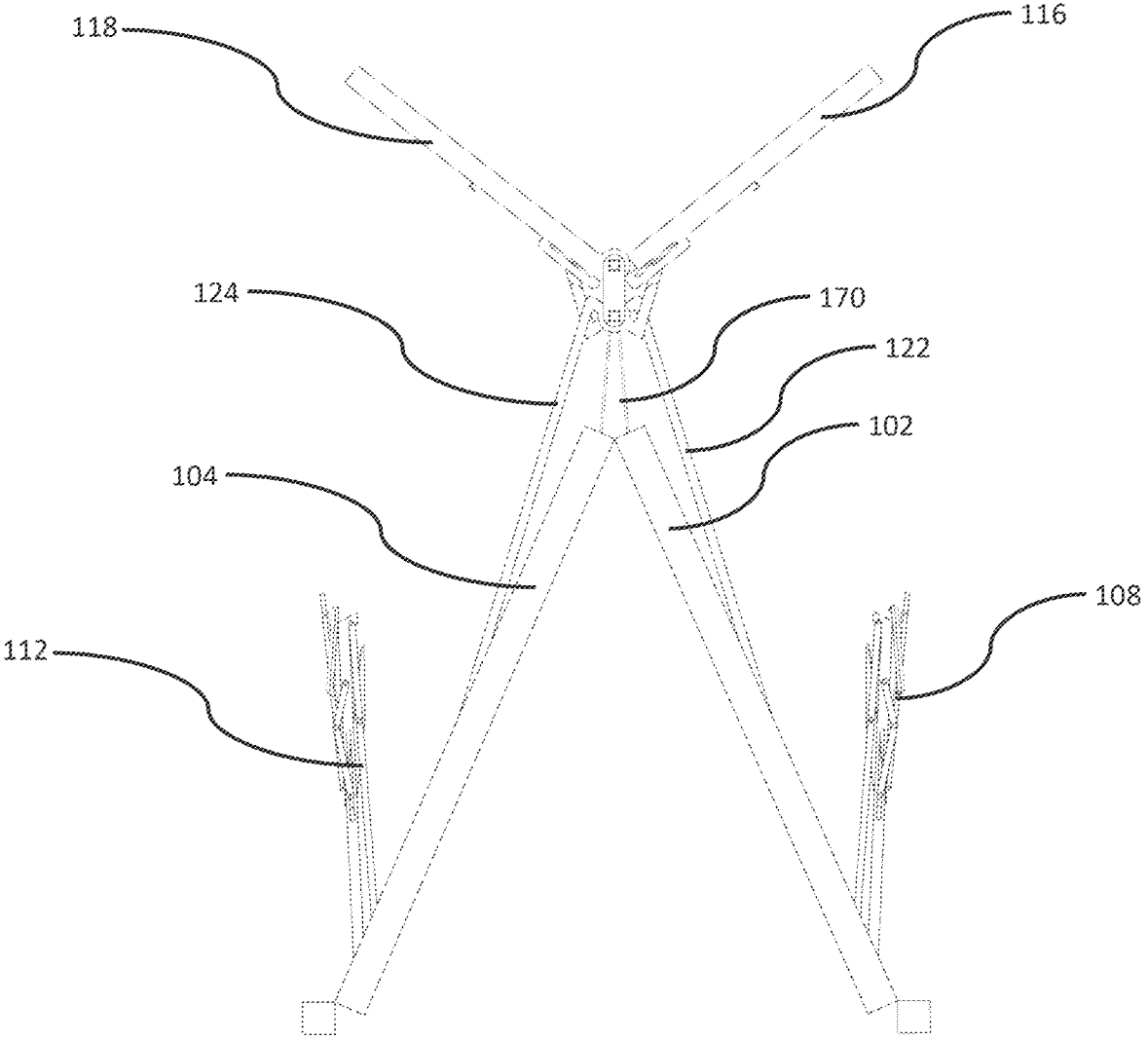
Figure 5C:
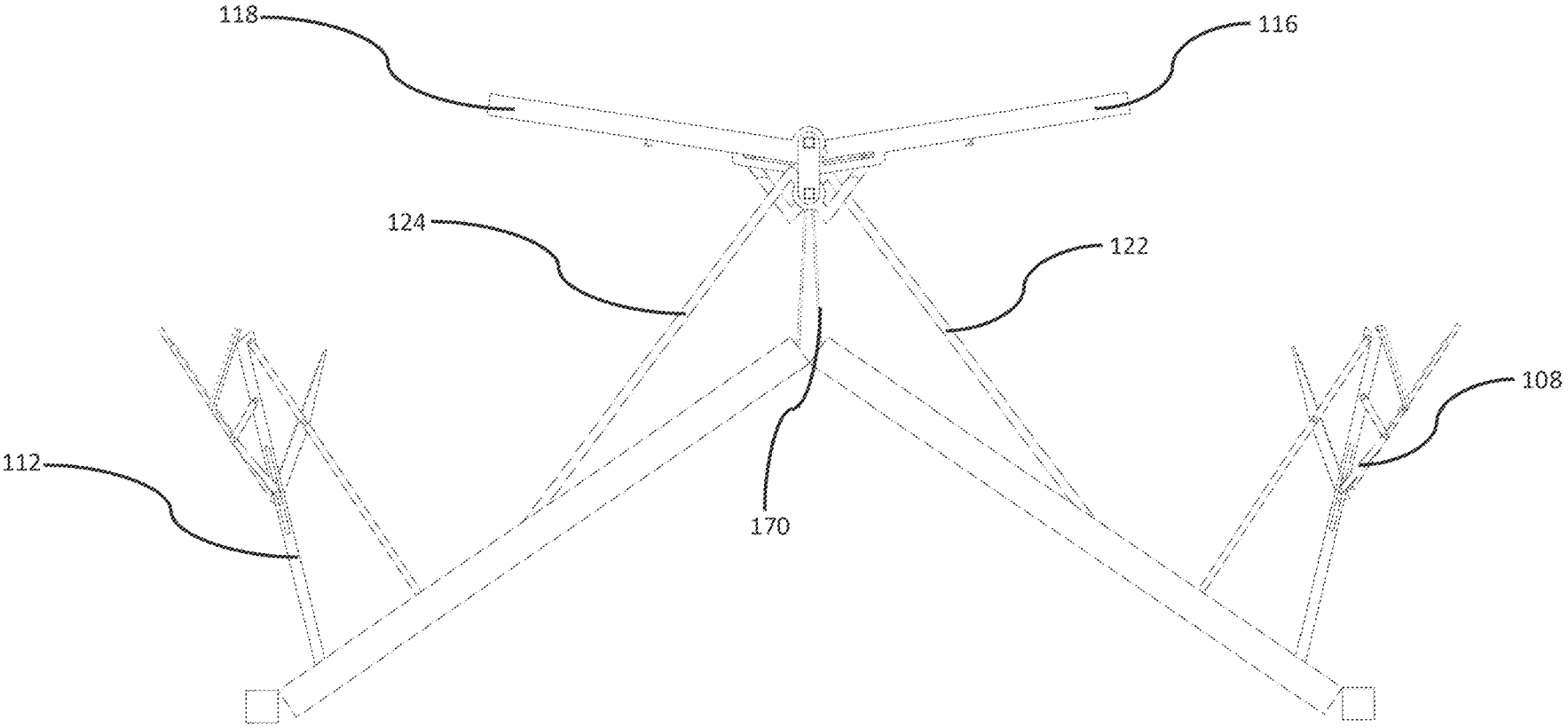
Figure 5D:
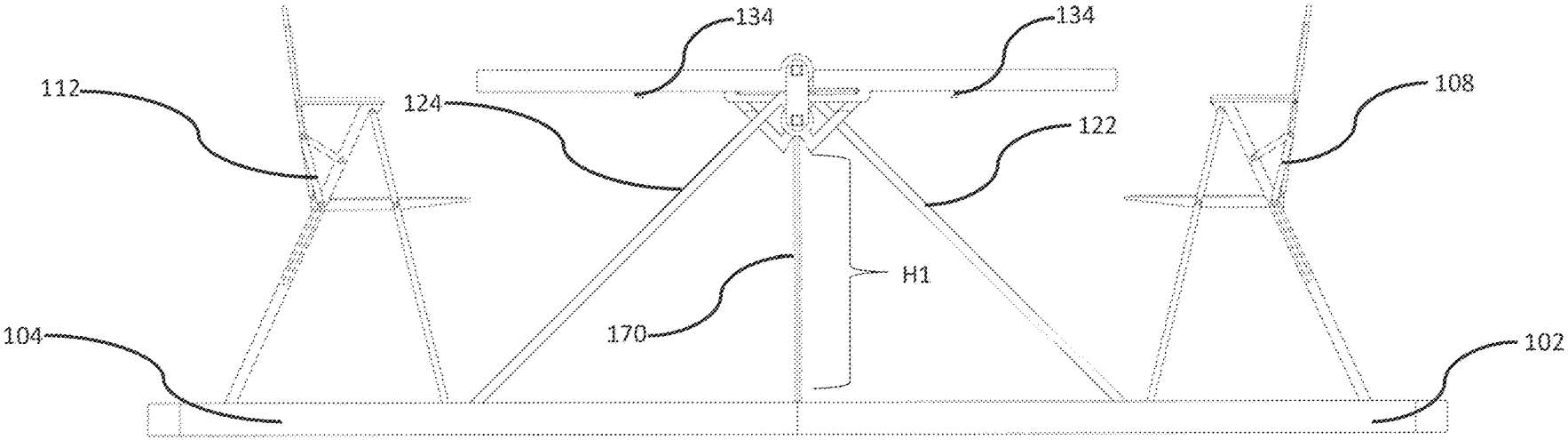

Referring now to FIGS. 1 and 5*a*-5*d*, for deploying the assembly 100, a cable pulling mechanism is included in the assembly 100. A cable 170 is positioned in the assembly 100 and passes through the floor panels 102,104. The cable 170 extends through the legs connecting horizontal member 152 wherein the cable 170 is pulled passively to expand the table and chair set assembly 100. As illustrated in FIGS. 5*b* and 5*c*, when the floor panels 102,104 move away from each other to transition to become coplanar, the chain 170 is passively pulled as illustrated in FIG. 5*d*. While the chain 170 is pulled, the top ends 158,164 slide along the channels 154,156 respectively. Similarly, the bottom ends 160,166 also slide along the floor panels to expand the table.

As illustrated in FIGS. 6*a*-6*c* and 9*a*, the chain 170 is extends up to the cable connection point 184 positioned at the end of the movable leg of each chair (such as point 184 of the leg 604 of the chair 112).

When the assembly 100 expands, the cable 170 becomes vertical to provide further support to the table 106. Also, when the floor panels 102,104 expand, the chairs also expand from the respective housings. It will be apparent to a person skilled in the art that in the side views FIGS. 5*a*-5*d*, only two chairs 108,112 are visible. The chairs automatically expand to transition into expanded position as illustrated in FIGS. 1 and 5*d*. The passive cable pulling extends the floor panels 102,104 and height of the cable 170 increases from H0 (FIG. 5*a*) to H1 (FIG. 5*d*), making the chair legs move forward to get the chair expanded.

Figure 5E:
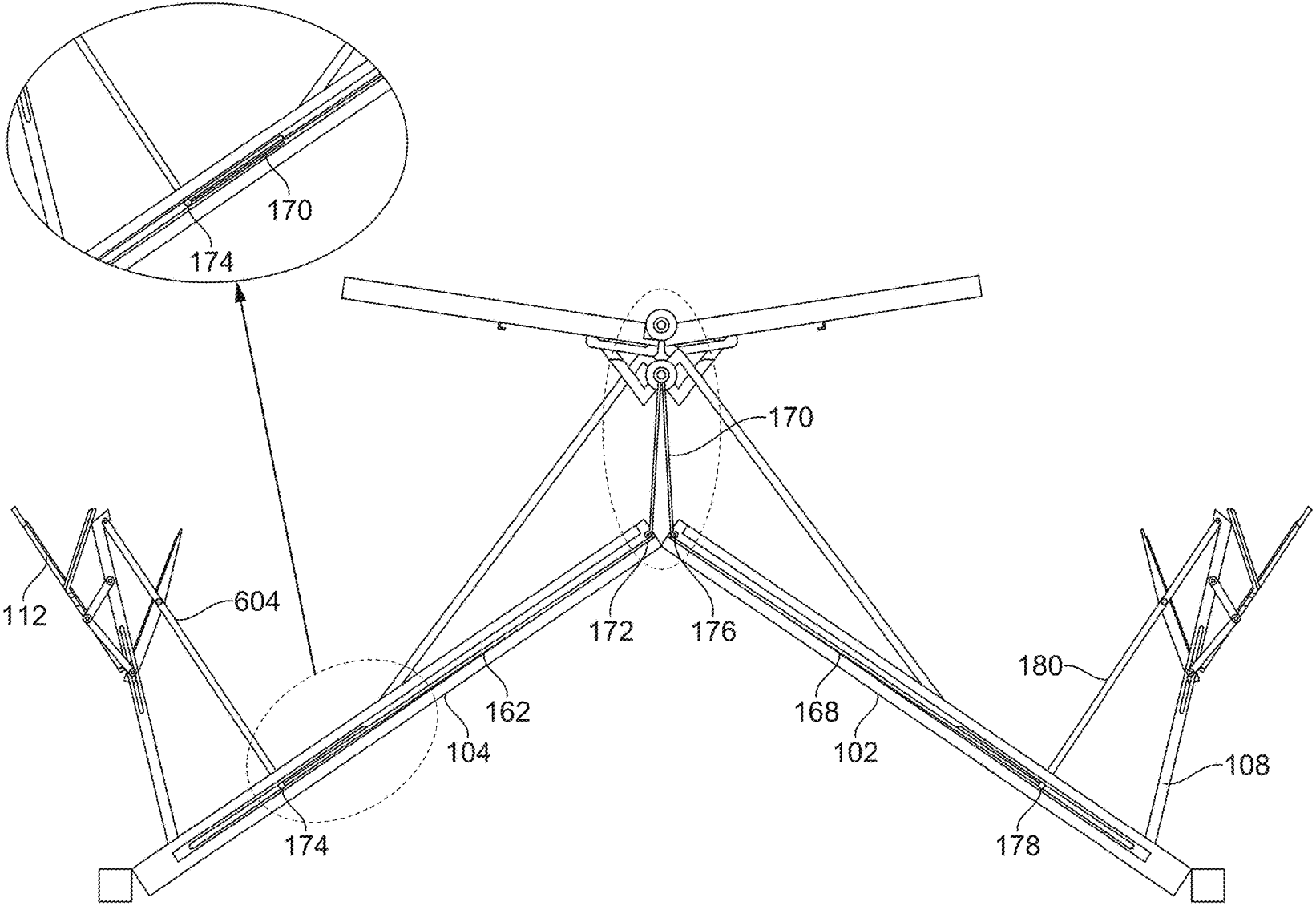
FIG. 5*e* illustrates a perspective view showing cable passing through the channels of the floor panels in accordance with embodiments of the invention.

Referring to FIG. 5*e*, the channels 162,168 are used for accommodating the chain 170. The channel 162 includes a cable guiding wheel 172 and a cable connection point 174. The cable is guided along the channel 162 using the cable guiding wheel 172 and the cable connection point 174. More specifically, during unfolding of the assembly 100, the cable 170 slides against the cable guiding wheel 172 and pull the chair leg 604 out. Similarly, the channel 168 includes a cable guiding wheel 176 and a cable connection point 178. The cable 170 slides against the cable guiding wheel 176 and the cable connection point 178 and pull the leg 180. Upon the full deployment of floor panels 104,102, the chair legs 604,180 are pulled out to expand the chairs 112,108 passively.

Referring now to FIGS. 6*a*-6*c* and 9*a*, passive deployment of the foldable chair is disclosed. The folding structure and mechanism of all the four chairs is the same. As illustrated, the back leg 602 of the chair 112 is fixed at the bottom end thereof. The front leg 604 is adjustable and can be pulled along the channel 606 disposed in the floor panel. Each chair has an independent channel disposed in the for panel for expanding and collapsing the chairs.

The chair 112 includes a backrest 608, an armrest 610, sliding connection member 612 and a seat 614. The sliding connection member 612 is adapted to slide along a slit 616 disposed in the back leg 602. When the front leg 604 is pulled away from the back leg 602, the sliding connection member 612 moves up along the slit 616 to move the seat 614 to a substantially horizontal position. The armrest 610 extends from the backrest 608 to the top end of the back leg 602.

Figure 6A:
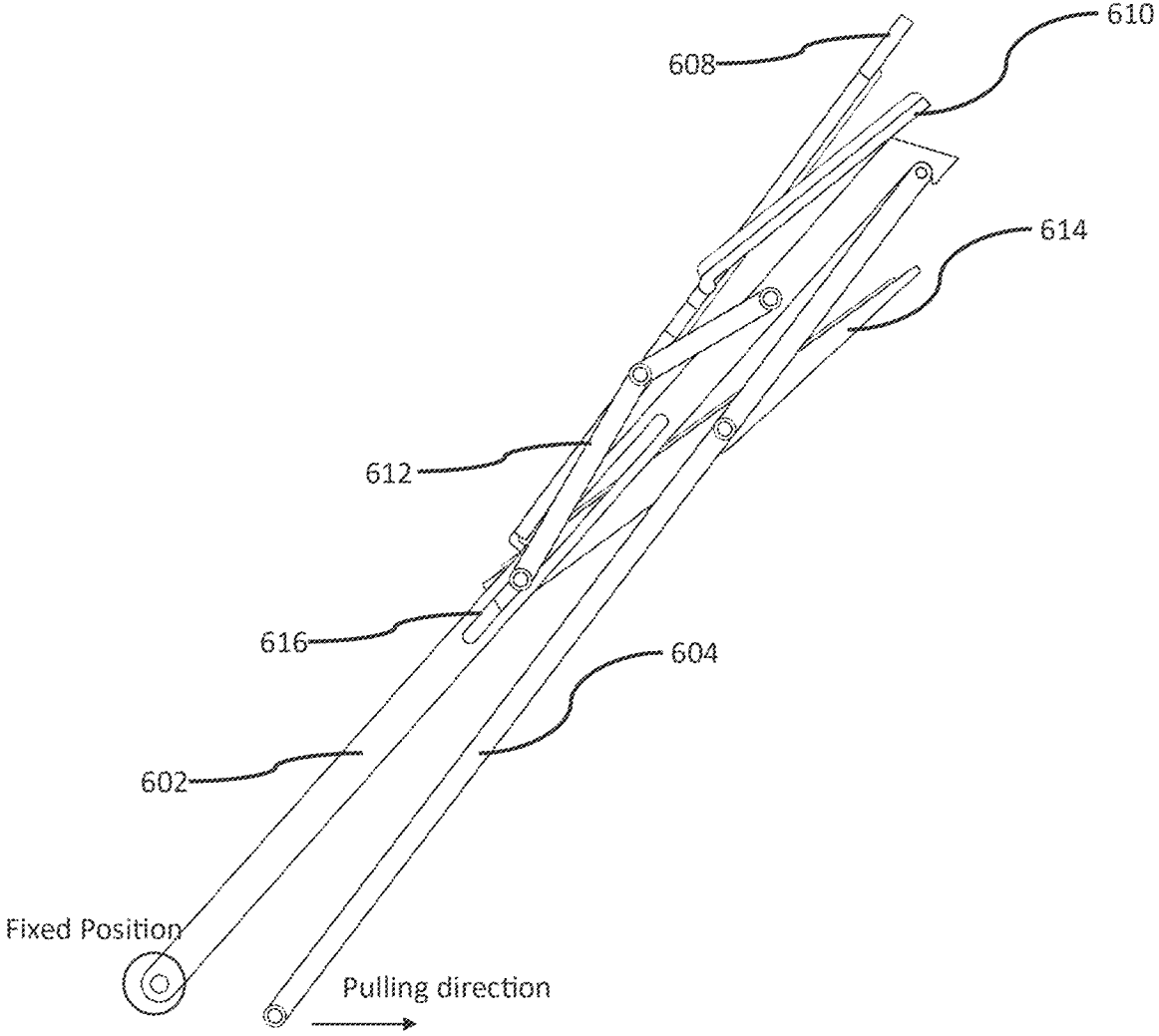
FIG. 6*a*-6*c* illustrate different steps used for expanding a chair, in accordance with embodiments of the invention.
Figure 6B:
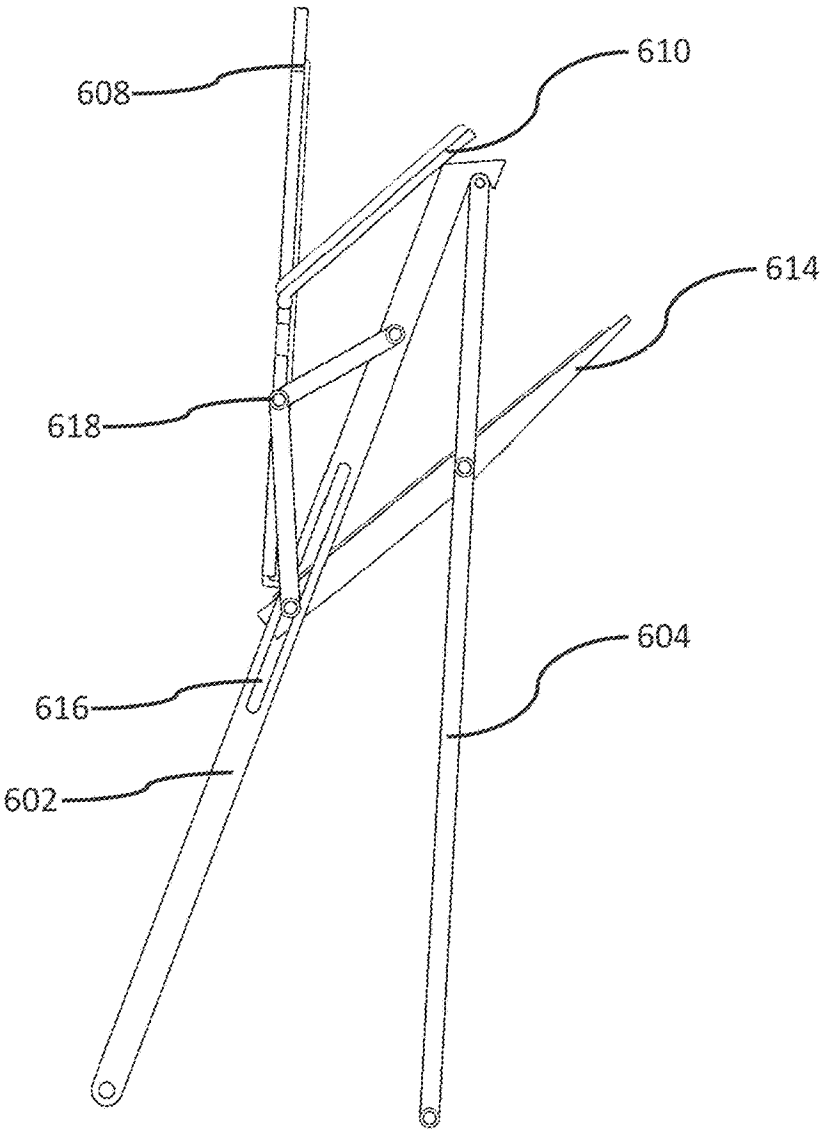
Figure 6C:
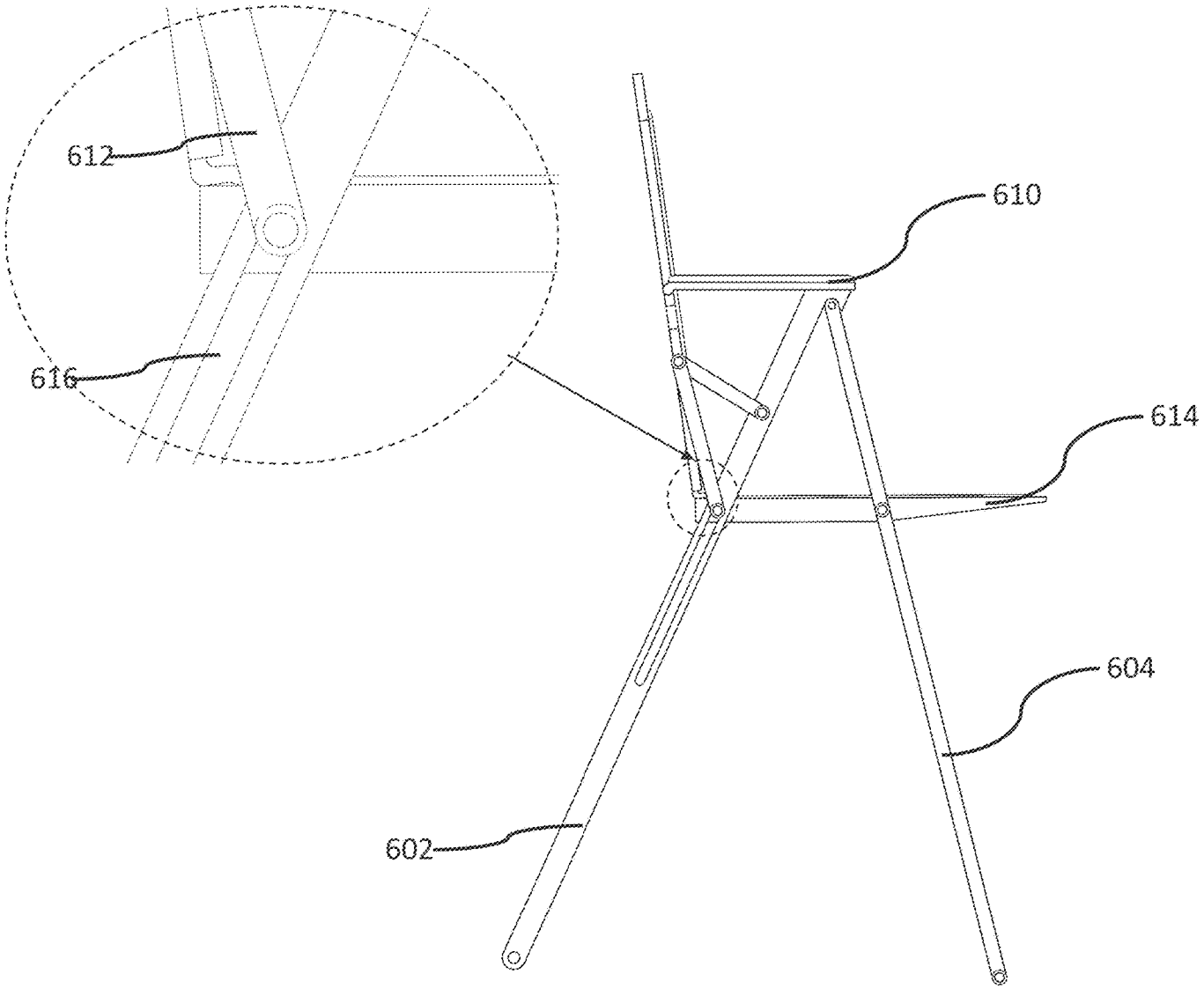

As illustrated in FIG. 6*c*, when front leg 604 is pulled completely, the sliding connection member 612 reaches the top end of the slit 616 and the hinge 618 pivotally supports the backrest 608 and the back leg 602. The seat 614 is also hingedly coupled to the sliding connection member 612 and the front leg 604.

Figure 7:
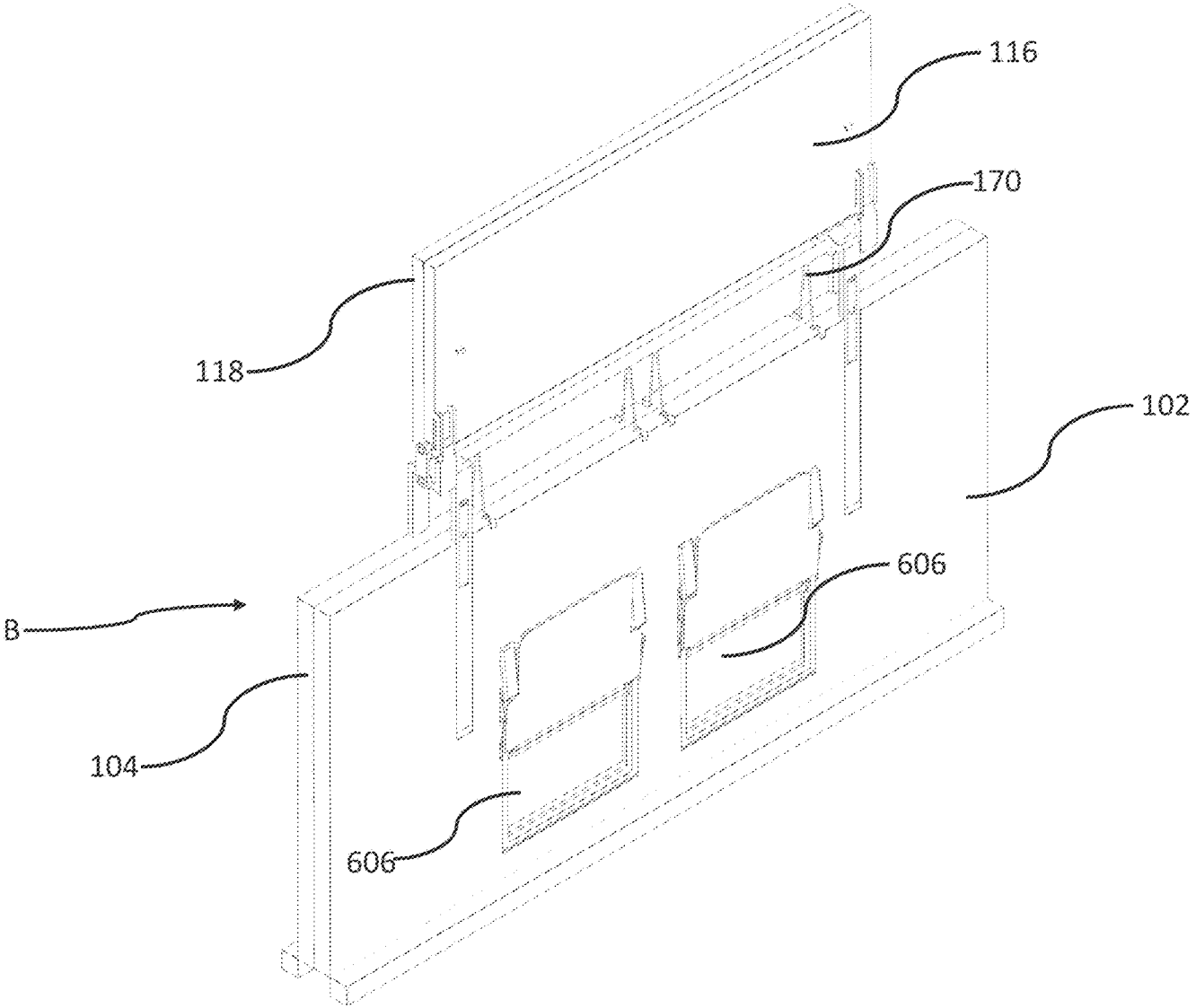
FIG. 7 illustrates the foldable table and chair set assembly of the present invention in a folded position, in accordance with embodiments of the invention.

FIG. 7 illustrates the table and chair set assembly 100 in a folded position, in accordance with one embodiment of the present invention. The panels 102,104 adhere to each other and push against each other in the folded position (Arrow B). The channel 606 of each individual chair is disposed in the panels. More specifically, the channels for the chairs 108,110 are disposed in the floor panel 102 and the channels for the chairs 112,114 are disposed in the floor panel 104. The rigid table 116,118 also push against each other with the cable 170 is positioned in a retractable position.

Figure 8:
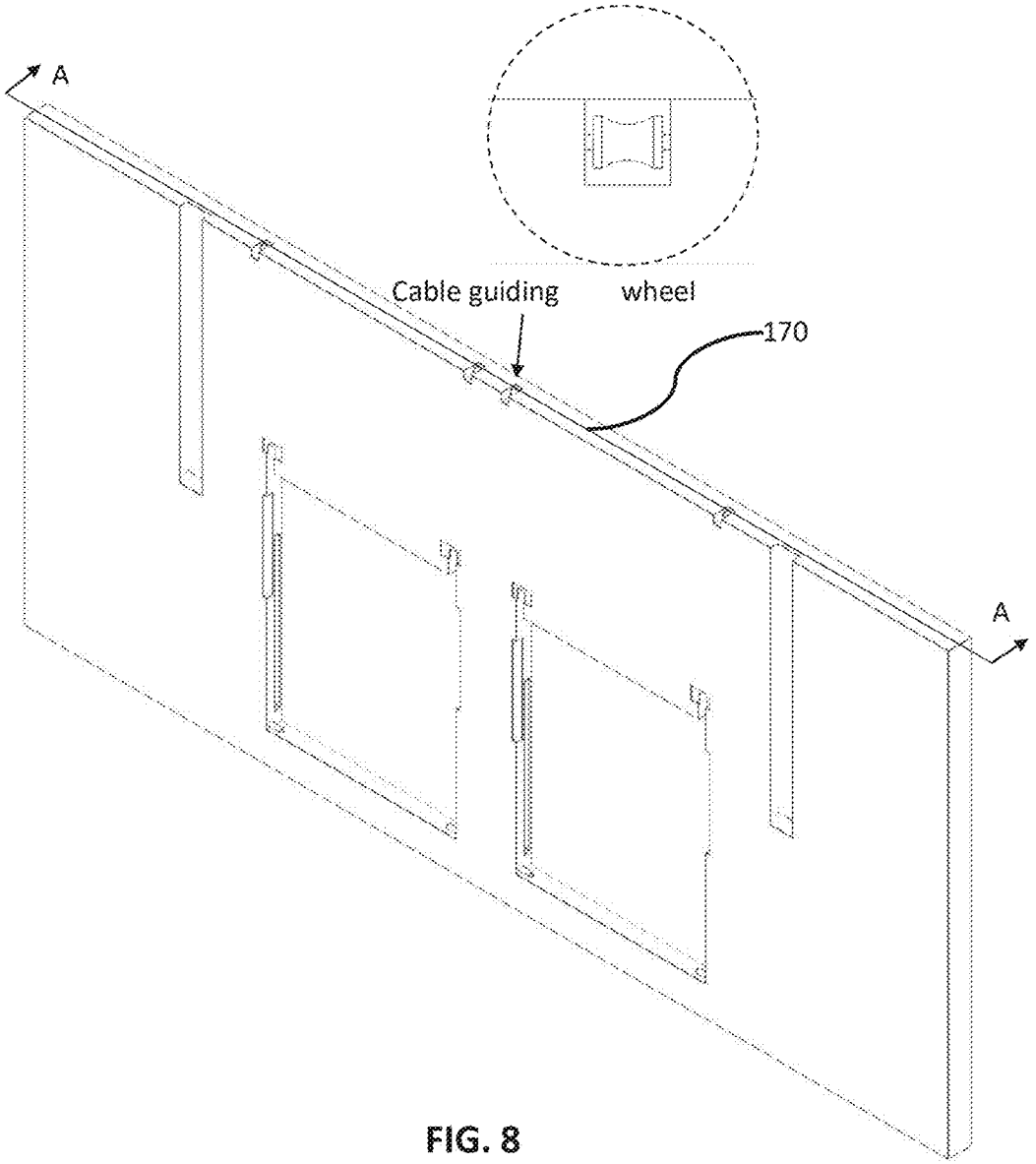
FIG. 8 illustrates the A-A cross-sectional view of the floor panel, in accordance with embodiments of the invention.

FIG. 8 illustrates A-A cross-sectional view of the assembly 100 in accordance with one embodiment of the present invention. The cable 170 passes through the table 106 and through the channel 606 of the chairs allowing the table 106 and the chairs to expand passively without any manual effort.

Figure 9A:
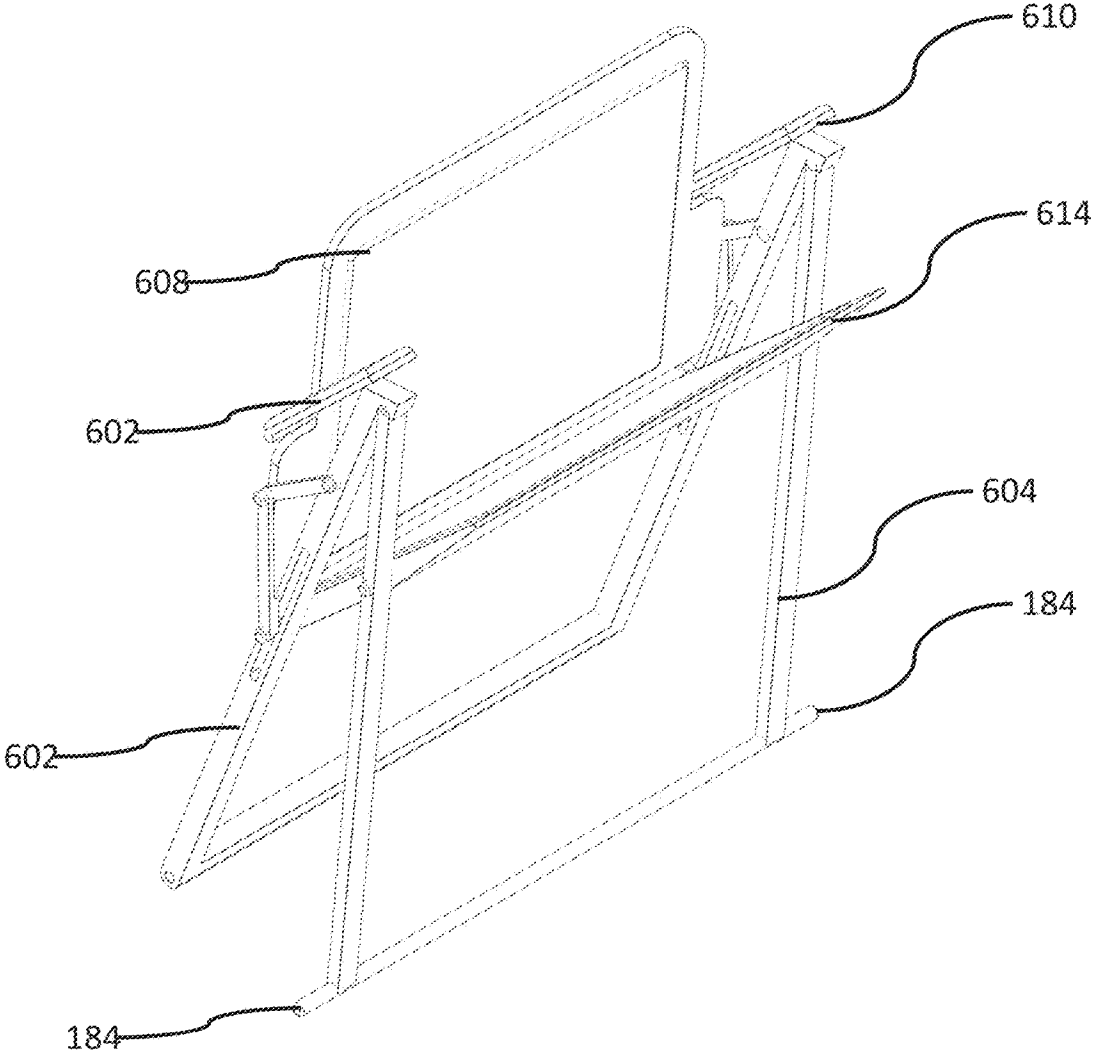
FIG. 9*a* illustrates a chair in transition from a folded position to the expanded position, in accordance with embodiments of the invention.
Figure 9B:
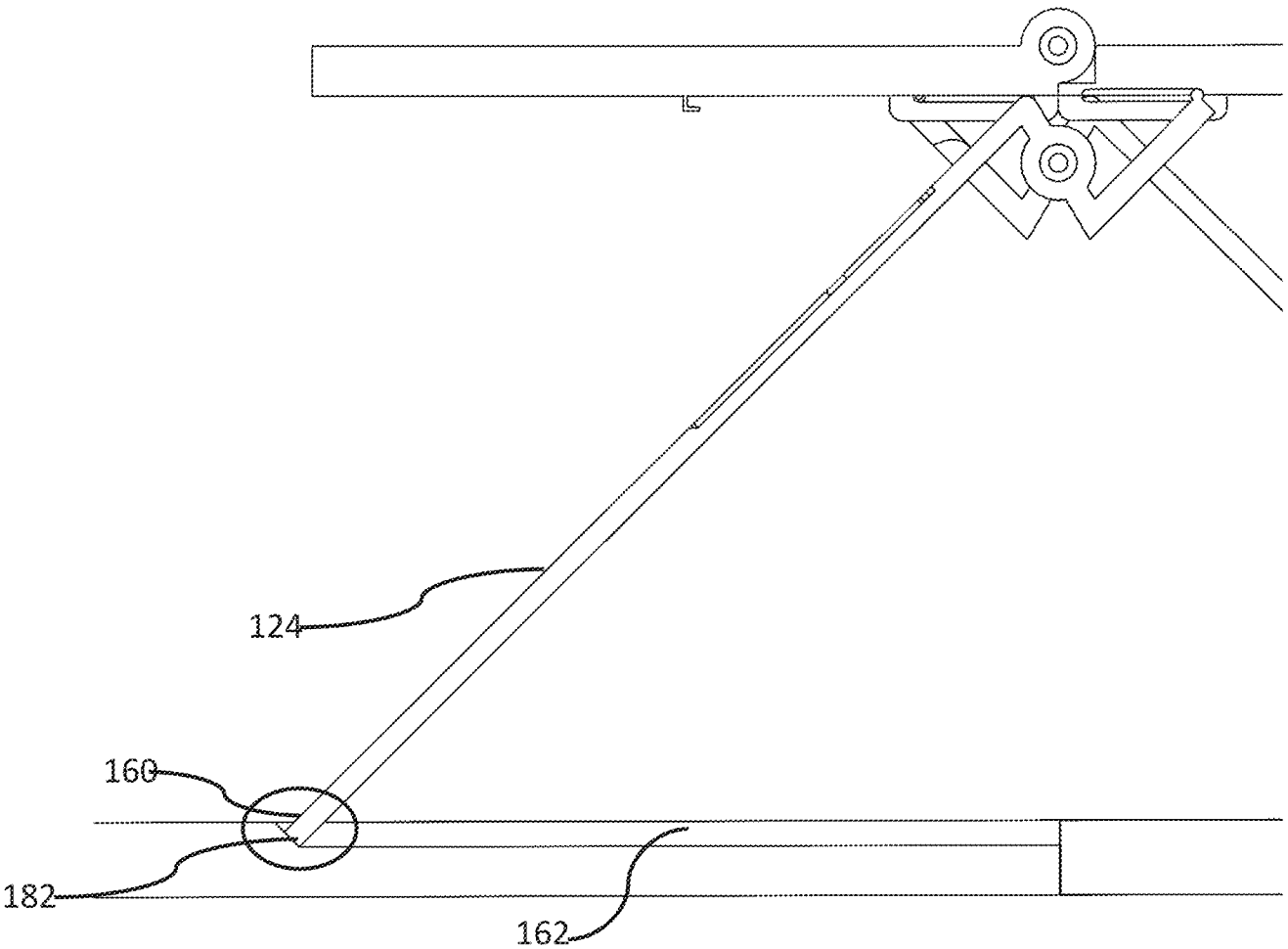
FIG. 9*b* illustrates a partial perspective view showing the hinged connection of the leg table in accordance with embodiments of the invention.

Referring to FIG. 9*b*, the bottom end 160 of the leg 124 is hinged at the end edge 182 of the channel 162. Similarly, the bottom end of all the other legs is hinged at the corresponding end edge of the respective channels. The edge or slot 182 is designed to prevent the leg 124 from moving and sliding.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

This invention is susceptible to considerable variation within the spirit and scope of the appended claims.

The claimed invention is:

1. A foldable table and chair assembly comprising:

a first floor panel and a second floor panel, both deployable in a coplanar alignment in the deployed position of the assembly;

a table deployed between a first pair of chairs and a second pair of chairs, positioned on opposite sides of the table;

said table including a first rigid pivotal rectangular member and a second rigid pivotal rectangular member pivotally connected to each other;

said table supported by a first pair of legs and a second pair of legs, with foldable panels associated with each leg for providing additional support to the table;

a sliding channel integrated to each rigid pivotal rectangular member, allowing the legs to slide for folding and unfolding the table;

a cable pulling mechanism with a cable extending through the floor panels, the table, and the pairs of the chairs enabling passive expansion of the assembly by passive pulling of the cable, when the floor panels move away from each other.

2. The foldable table and chair assembly of claim 1, wherein the floor panel has channel for sliding a front leg of a chair;

the chair comprising a back leg, a front leg, a backrest, an armrest, a sliding connection member, and a seat;

said sliding connection member adapted to slide along a slit in the back leg, with a hinge pivotally supporting the backrest and the back leg, and the seat hingedly coupled to the sliding connection member and the front leg;

wherein pulling the front leg away from the back leg causes the sliding connection member to move along the slit, moving the seat to a substantially horizontal position, and further pulling the front leg enables the sliding connection member to reach a top end of the slit, at which point the hinge pivotally supports the backrest and the back leg, and the seat remains substantially horizontal.

3. A furniture assembly comprising:

a first floor panel and a second floor panel, the first floor panel and the second floor panel are in coplanar alignment in a deployed position and the first floor panel and the second floor panel press against each other in a folded position;

an expendable table having a first rigid member and a second rigid member, the first rigid member and the second rigid member are in coplanar alignment when expanded and the press against each other when folded;

a first pair of chairs disposed in the first floor panel;

a second pair of chairs disposed in the second floor panel;

each chair of the first pair of chairs and the second pair of chairs is adapted to transition between an expanded position and a folded position, wherein a front leg of the chair slides along a channel disposed in the corresponding floor panel to expand the chair; and a cable adapted to passively pulled to expand the table, the first pair of chairs and the second pair of chairs.

4. The furniture assembly of claim 2, wherein the table has a first pair of legs, a second pair of legs, each leg of the first pair of legs and the second pair of legs is adapted to slide along a first channel disposed in a rigid member of the table and along a second channel disposed in the floor panel.

* * * * *